US005996328A

United States Patent [19]

King et al.

[11] Patent Number: 5,996,328

[45] Date of Patent: Dec. 7, 1999

[54] METHODS AND SYSTEMS FOR FORMING MULTI-FILAMENT YARNS HAVING IMPROVED POSITION-TO-POSITION CONSISTENCY

[75] Inventors: Willis M. King; Melvin R. Thompson; Andrew M. Coons, III; Myles W. Sterling, all of Anderson; Leroy Boseman, Belton; Donald E. Wright, Anderson, all of S.C.

[73] Assignee: BASF Coporation, Mt. Olive, N.J.

[21] Appl. No.: 08/955,598

[22] Filed: Oct. 22, 1997

[51] Int. Cl.[6] ..... D01H 13/26

[52] U.S. Cl. ..... 57/351; 28/103; 28/140; 28/247; 57/284; 57/285; 57/289; 57/350; 57/352; 57/354; 57/908

[58] Field of Search ..... 57/284, 285, 289, 57/350, 351, 352, 354, 357, 358, 908; 28/103, 140, 247, 271, 274

[56] References Cited

U.S. PATENT DOCUMENTS

| | | | |
|---|---|---|---|
| Re. 31,376 | 9/1983 | Sheehan et al. | 57/208 |
| 3,479,810 | 11/1969 | Eshuis | 57/140 |
| 3,552,114 | 1/1971 | Mototada Fukuhara et al. | 57/140 |
| 3,908,248 | 9/1975 | Schmid et al. | 28/1.4 |
| 4,028,875 | 6/1977 | Yu et al. | 57/157 TS |
| 4,194,350 | 3/1980 | Schellenberg et al. | 57/352 |
| 4,280,261 | 7/1981 | Nelson | 57/6 |
| 4,299,015 | 11/1981 | Marcus et al. | 28/221 |
| 4,343,146 | 8/1982 | Nelson | 57/208 |
| 4,497,099 | 2/1985 | Scott | 28/220 |
| 4,615,167 | 10/1986 | Greenberg | 57/6 |
| 4,644,620 | 2/1987 | Maeda | 28/220 |
| 4,644,622 | 2/1987 | Bauer et al. | 28/271 |
| 4,841,606 | 6/1989 | Coons, III | 28/274 |
| 4,894,894 | 1/1990 | Coons, III et al. | 28/220 |
| 4,897,989 | 2/1990 | Gray | 57/239 |
| 4,993,130 | 2/1991 | Coons, III et al. | 28/271 |
| 5,040,276 | 8/1991 | Coons, III et al. | 28/220 |
| 5,148,586 | 9/1992 | Coons, III | 28/271 |
| 5,184,381 | 2/1993 | Coons, III et al. | 28/271 |
| 5,195,313 | 3/1993 | Coons, III | 57/264 |
| 5,221,059 | 6/1993 | Coons, III et al. | 242/147 R |
| 5,226,271 | 7/1993 | Karbu | 57/293 |
| 5,325,572 | 7/1994 | Dickson, III et al. | 28/278 |
| 5,327,622 | 7/1994 | Coons et al. | 28/220 |
| 5,613,285 | 3/1997 | Chester et al. | 28/247 |
| 5,775,087 | 7/1998 | Goineau | 57/908 |
| 5,802,836 | 9/1998 | Curran et al. | 57/351 |

OTHER PUBLICATIONS

Article re: BASF Expands Range With New Yarn Systems; Garvin K.; Floor Covering Weekly, 43, No. 37: 18 (Oct. 24/31, 1994).

*Primary Examiner*—William Stryjewski

[57] ABSTRACT

Individual differently colored or colorable feed filament ends are withdrawn from respective creel-mounted packages and passed through a separation guide. The separation guide serves to "normalize" the filament end-to-end positions and tensions. That is, the separation guide will cause the individual feed ends to be in specific predetermined positions relative to the other feed ends regardless of the position of the package on the creel. In addition, the separation guide will effectively cause a short length of each feed end to be parallel to, and separated by a substantially uniform distance from, corresponding lengths of the other feed ends. This parallel alignment of individual end lengths and the substantially uniform filament end-to-end positioning thereby imparts substantially uniform tensions on the feed ends while substantially maintaining their respective positions in the combined yarn product relative to one another. The position- and tension-normalized feed ends are thereafter immediately passed from the separation guide to an interlacer. The interlacer serves to positionally lock the combined feed filaments to one another so that substantially no filament end migration will ensue as the combined yarn is further processed (e.g., during downstream draw-texturing operations).

22 Claims, 2 Drawing Sheets

METHODS AND SYSTEMS FOR FORMING MULTI-FILAMENT YARNS HAVING IMPROVED POSITION-TO-POSITION CONSISTENCY

FIELD OF THE INVENTION

The present invention pertains to the field of continuous synthetic filaments, and particularly, to yarns comprised of multiple continuous filaments. In preferred forms, the present invention pertains to yarns comprised of differently colored or colorable continuous synthetic filaments which are especially suitable for the production of carpets.

BACKGROUND AND SUMMARY OF THE INVENTION

Carpet manufacturers are continually searching for yarns which provide distinct visual appearance when converted into cut, loop pile or cut-loop pile carpet structures. For example, continuous filament carpet yarns which provide a heather appearance to the final carpet structure (i.e., a visual appearance of small points of individual color, called "color points", randomly distributed throughout a matrix of contrasting colors) have achieved widespread popularity.

Problems are encountered, however, when differently colored filament ends are combined. For example, one common problem that is encountered is the visual predominance in the resulting combined multi-filament yarn of one particular filament color which gives the filament combination a color cast toward the color of the color-dominant filament or filaments. This problem is exacerbated when several yarn production positions making the same specified final yarn product (i.e., combining the same differently colored filament ends), in reality, produce yarn products which vary from one another by their perceptibly different color casts. Thus, even though the same number of differently colored filament ends are combined to produce ostensibly the same finished multi-colored yarn product, the inherent minor variations in processing conditions (e.g., filament tension, surface conditions, finish, machine alignment, feed yarn denier and the like) that exist inherently between the feed ends and/or from one machine position to the next will cause variations among the finished yarn products in terms of their respective color casts.

It would therefore be highly desirable if methods and systems were provided which improve the consistency of multicolored yarn products. It is toward providing such a solution that the present invention is directed.

Broadly, the present invention is embodied in methods and systems whereby differently colored or colorable synthetic filament ends are combined so as to achieve more consistent yarn coloration. More specifically, the present invention is embodied in methods and systems whereby the individual filament end-to-end positions and tensions are normalized so as to minimize (if not substantially eliminate) the inherent variances that are present during yarn production.

In one particularly preferred embodiment of the present invention, the individual differently colored or colorable feed filament ends are withdrawn from respective creel-mounted packages and passed through a separation guide. The separation guide serves to "normalize" the filament end-to-end positions and tensions. That is, the separation guide will cause the individual feed ends to be in specific predetermined positions relative to the other feed ends regardless of the position of the package on the creel. In addition, the separation guide will effectively cause a short length of each feed end to be parallel to, and separated by a substantially uniform distance from, corresponding lengths of the other feed ends. This parallel alignment of individual end lengths and the substantially uniform filament end-to-end positioning thereby imparts substantially uniform tensions on the feed ends while substantially maintaining their respective positions in the combined yarn product relative to one another.

The position- and tension-normalized feed ends are thereafter immediately passed from the separation guide to an interlacer. The interlacer serves to positionally lock the combined feed filaments to one another so that substantially no filament end migration will ensue as the combined yarn is further processed. Most preferably, the interlacer will create regular temporary or "soft" nodes in the combined feed yarn to an extent that the individual filaments of the yarn cohere to one another in the region of the node. These nodes are present so as to maintain the relative positions of the feed ends and are thus released during further downstream processing (e.g., draw-texturing).

The more consistent yarn coloration achieved by the process of the present invention has been found to result in improved carpet uniformity. For example, carpet uniformity has been found to improve from a commercial grade 6 to about a commercial grade 8 when carpets are formed with yarns produced by the process of the present invention.

Other aspects and advantages of the present invention will become apparent after careful consideration is given to the following detailed description of the preferred exemplary embodiments.

BRIEF DESCRIPTION OF THE ACCOMPANYING DRAWINGS

Reference will hereinafter be made to the accompanying drawings wherein like reference numerals throughout the various FIGURES denotes like structural elements, and wherein, FIG. 1 is a schematic view of a synthetic multi-filament yarn processing system according to the present invention; and FIG. 2 is an enlarged schematic cross-sectional elevational view of a pre-draw air box that is employed in the system depicted in FIG. 1.

DETAILED DESCRIPTION OF THE INVENTION

Figure 1:
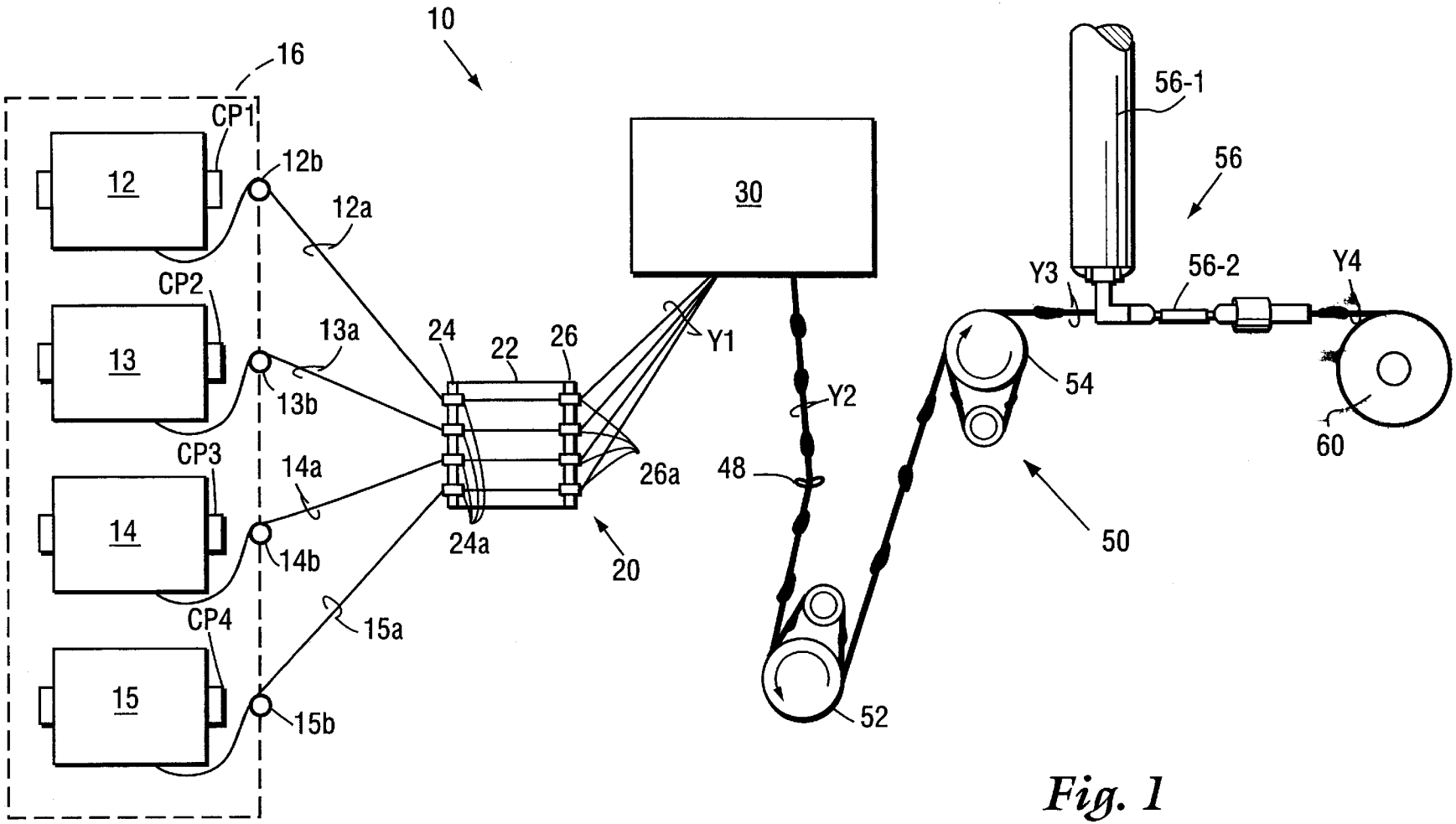

For the purpose of promoting an understanding of the principles of the invention, reference will be made to the embodiment illustrated in the drawing FIGURES and specific language will be used to describe the same. It will nevertheless be understood that no limitation of the scope of the invention is thereby intended, such alterations and a further modifications in the illustrated device, method and resulting product, and such further applications of the principles of the invention as illustrated therein being contemplated as would normally occur to one skilled in the art to which the invention pertains.

A. Definitions

As used herein and in the accompanying claims, the term "continuous filament" refers to fibers of indefinite or extreme length. The term "continuous yarn" refers to a strand or bundle which includes one or more continuous filaments. A "filament end" may container either a single continuous filament or multiple continuous filaments. Thus, an end may be a continuous yarn.

The term "cohere" or "coherent" means to stick or hold together in a visually identifiable and distinguishable mass.

The terms "blend" and "commingle" mean to intimately and thoroughly mix so that constituent components become nearly indistinguishable. When used in reference to yarns, therefore, commingling results in filament blending to an extent that the filaments of one yarn become substantially indistinguishable from the filaments which constitute another yarn or yarns.

The term "interlaced" means a yarn which contains nodes or relatively compact sections separated by relatively bulky or unentangled sections, such as shown in U.S. Pat. No. Re. 31,376 to Sheehan et al, the entire content of which is expressly incorporated hereinto by reference. The term "interlacer" refers to a device which achieves an interlaced yarn.

The terms "entangle" and "entangling" mean to mix components to an extent that the individual components cohere to one another. In the context of multiple yarns, therefore, the terms "entangle" and "entangling" may or may not involve interlacing.

The terms "node harshness" and "yarn harshness" are as defined in U.S. Pat. No. 5,184,381 issued to Coons, III et al on Feb. 9, 1993, the entire content of which is expressly incorporated hereinto by reference. Thus, a "soft node" is a node in a continuous yarn having a node harshness of less than about 2.0.

A yarn "node" is a region of filament entanglement. By the term "regular nodes" is meant that a yarn has nodes that are spaced apart from one another by no more than 6 centimeters, even though node-to-node spacing may be unequal along the length of the yarn.

B. Description of the Accompanying Drawing Figures

A particularly preferred system 10 according to the present invention is shown schematically in accompanying FIG. 1. In this regard, feed ends 12*a* through 15*a* are supplied from their respective packages 12 through 15 located at creel positions CP1 through CP4, respectively, associated with a conventional creel structure (depicted schematically by reference numeral 16). The individual feed ends 12*a*–15*a* can be virtually any desired combination of different colored or colorable filaments. For example, one or more feed ends 12*a*–15*a* may be of the same color while the remaining feed ends 12*a*–15*a* may be of another color. The individual feed ends 12*a*–15*a* may also be themselves multicolored or multi-colorable if in the form of multi-filament yarns. Furthermore, more or less than the number of feed ends depicted in FIG. 1 may be employed in accordance with the present invention. Suffice it to say here, however, that those of ordinary skill in the art may devise virtually any combination of feed ends to achieve the desired coloration for the finished yarn product.

The feed ends 12*a*–15*a* pass through respective conventional take-off guides 12*b*–15*b* associated with the creel structure 16 and on to the separation guide 20 in accordance with the present invention. As depicted, the separation guide 20 is generally a U-shaped structure having a base 22 and rearward and forward support flanges 24, 26, respectively. The rearward and forward support flanges carry a respective one of a coaxial pair of rearward and forward low friction guide eyelets 24*a*, 26*a*, respectively.

The individual eyelet pairs 24*a*, 26*a* are disposed relative to one another so that the feed ends 12*a*–15*a* passing therethrough are separated from one another by a substantially uniform distance (i.e., as determined by the distance between the rearward and forward flanges 24, 26 which carry the eyelets 24*a*, 26*a*, respectively) and are oriented substantially parallel relative to one another. The eyelet pairs 24*a*, 26*a* thus establish therebetween a lengthwise segment of each one of the feed ends 12*a*–15*a* which is positionally fixed relative to each of the other feed ends 12*a*–15*a*. The substantially parallel equidistant positions of the feed ends 12*a*–15*a* is most preferably maintained over a distance 28 sufficient to substantially normalize the tensions on each of the feed ends—that is, so that the tension on one of the feed ends 12*a*–15*a* is substantially the same as the tension on the other feed ends 12*a*–15*a*. In practice, this distance 28 (termed the "normalization distance") is preferably greater than about 1 cm, and more typically between about 3 to about 9 cms.

The feed ends 12*a*–15*a* are converged downstream of the separation guide 20 to form a combined yam Y1 which enters a pre-draw air box 30. In this regard, the separation guide 20 and the air box 30 are in relatively close proximity to one another so that the tension-normalized feed ends can be positionally temporarily "locked"0 by means of the air box. In practice, the distance the feed ends travel from exiting the separation guide 20 to their entrance into the air box 30 is typically between about 0.5 to about 10 times the normalization distance 28, and usually between about 2 to about 5 times the normalization distance 28.

Figure 2:
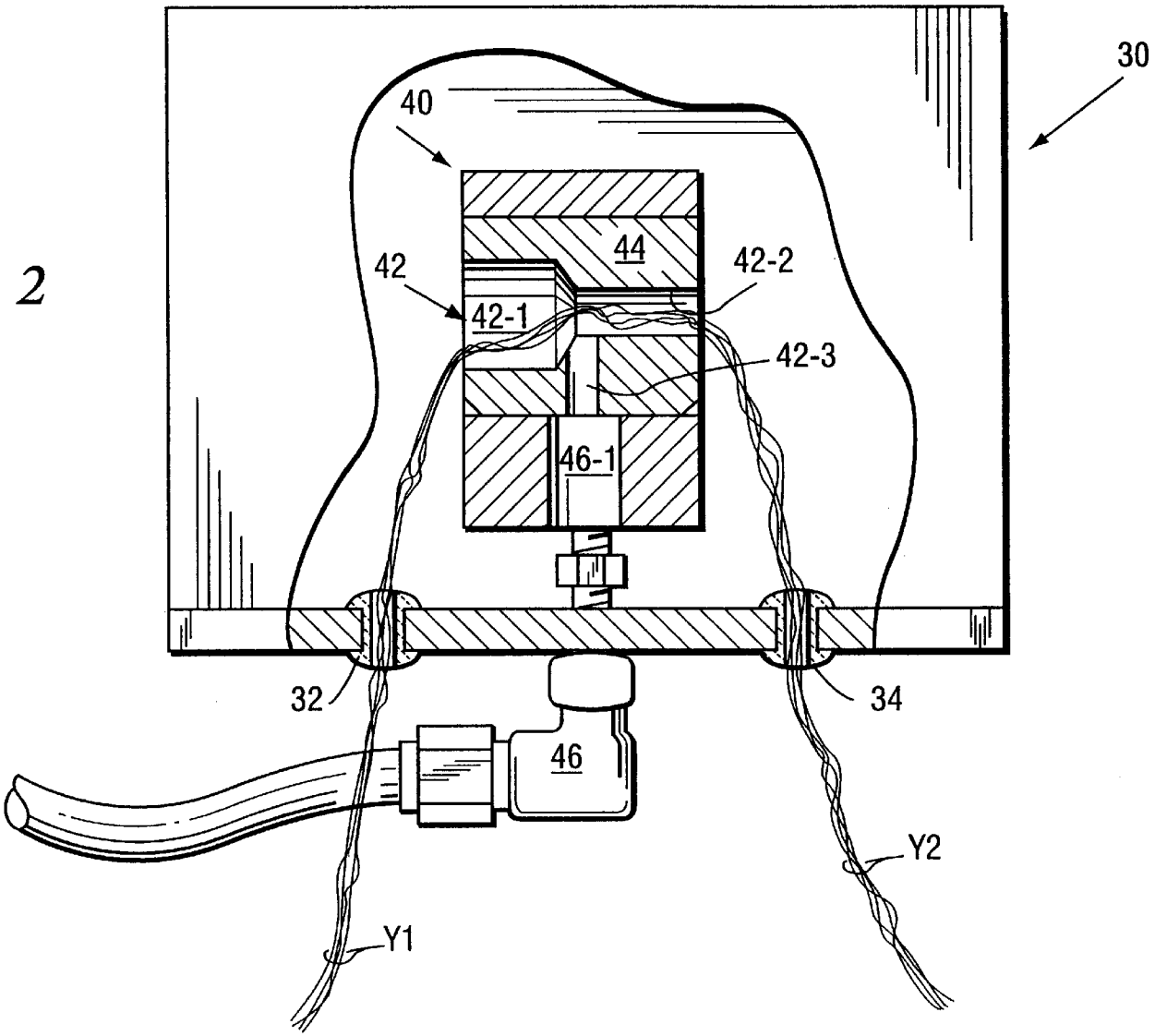

The air box 30 is depicted in greater detail in accompanying FIG. 2. In this regard, the air box 30 includes inlet and outlet guides 32, 34, which respectively direct the combined yarn Y1 into the air box 30 and allows the interlaced yarn (now designated Y2) to exit the air box 30.

The air box 30 contains an interlacer 40 of conventional design. Preferably, the interlacer 40 is as described in U.S. Pat. No. 4,841,606 issued to Andrew M. Coons, III, the entire content of which is expressly incorporated hereinto by reference. Thus, as shown in FIG. 2, the interlacer 40 includes a yarn passageway 42 formed through an interlacer body 44. The yarn passageway 42 is comprised of two concentric cylindrical bores 42-1, 42-2 of different diameters positioned coaxially in an end-to-end manner. An air inlet 42-3 of lesser diameter intersects the larger cylindrical passage bore 42-1 perpendicular to the direction of yarn passage therethrough (arrow A-1). Yarn threaded through the passageway 42 normally enters the larger bore 42-1. Air or other fluid from a supply (not shown) enters the yarn passageway 42 via supply conduit 46 and entranceway 46-1 which fluid-communicates with air inlet 42-3. By controlling the duration of the fluid jet entering the passageway 42 via the inlet 42-3 and/or pressure of the fluid, the interlaced yarn Y2 having the desired soft nodes regularly spaced apart along the yarn lengths with result.

Preferably, the fluid entering the air inlets 42-3 and 46-1 via the supply conduit 46 has a pressure between about 10 to about 50 psig. Moreover, the pressurized air is most preferably supplied to the passageway 42 in substantially steady state (i.e., without periodic air supply interruptions). In this regard, the interlacer is operated so as to impart relatively soft, regular nodes to the interlaced yarn Y2. That is, the interlaced yarn Y2 will have regular nodes having an average node harshness of no more than about 2.0 corresponding to a yarn harshness of less than about 100.

The yarn Y2 passes through an intermediate guide 48 enroute to the downstream draw-texturing operation 50. Specifically, the yarn Y2 exiting the air box 30 is wrapped around, and drawn between lower and upper Godets 52, 54. The drawn yarn (now designated Y3) is fed into a texturizer 56. One useful texturizer that may be employed in the practice of this invention is a texturizing tube 56-1 which is heated by means of heated fluid entering though conduit

56-2 as disclosed more completely in U.S. Pat. No. 3,908, 248, the entire content of which is expressly incorporated hereinto by reference. The drawn and textured yarn (now designated Y4) may then be taken up into a cylindrical yarn package 60 using a conventional winder (not shown).

What is claimed is:

1. A method of producing draw-textured synthetic continuous yarn comprising:

(a) conveying a plurality of synthetic filament feed ends through a separation guide and causing the respective feed ends to assume a substantially parallel equidistant position relative to one another;

(b) entangling the feed ends downstream of the separation guide so as to form an entangled yarn; and thereafter (c) draw-texturing the yarn.

2. The method of claim 1, wherein said feed ends include differently colored or colorable continuous filaments.

3. The method of claim 1, wherein step (a) is practiced such that said substantially parallel equidistant position is maintained over a distance sufficient to substantially normalize tension on said feed ends.

4. The method of claim 3, wherein said distance is at least 1 cm.

5. The method of claim 3, wherein said distance is between about 3 cms to about 9 cms.

6. The method of claim 1, wherein step (b) is practiced by forming regular nodes in said yarn which are spaced apart by no more than 6 cms.

7. The method of claim 6, wherein step (b) is practiced such that said nodes have a node harshness of less than 2.0.

8. The method of claim 1, wherein step (c) includes drawing the entangled yarn between a pair of Godet rolls.

9. The method of claim 8 wherein step (c) includes texturing the entangled yarn downstream of said Godet rolls.

10. The method of claim 9, wherein said texturing of said entangled yarn includes passing the entangled yarn through a heated texturizing tube.

11. A system of producing draw-textured synthetic continuous yarn comprising:

a separation guide which receives a plurality of synthetic filament feed ends and causes the feed ends to assume a substantially parallel equidistant position relative to one another;

an air entangler downstream of said separation guide for receiving the tension-normalized feed ends from the separation guide and entangling the feed ends to thereby form a yarn; and a draw-texturing apparatus downstream of said air entangler for draw-texturing the yarn.

12. The system as in claim 1, wherein said separation guide includes a plurality of coaxially aligned pairs of guide eyelets each for receiving a respective one of said feed ends.

13. The system of claim 12, wherein said separation guide is a U-shaped structure comprised of a base and rearward and forward support flanges carrying respective ones of said guide eyelets.

14. The system of claim 11, wherein said air entangler includes an interlacer jet having a jet body, a passageway formed through said jet body, and a fluid inlet port formed substantially perpendicularly to said passageway.

15. The system of claim 14, wherein said interlacer jet includes relatively larger and smaller diameter cylindrical passageways oriented end-to-end.

16. The system of claim 11, wherein said draw-texturing apparatus includes a pair of Godet rolls for drawing the yarn.

17. The system of claim 16, wherein said draw-texturing apparatus includes a heated texturizing tube downstream of said Godet rolls.

18. The system of claim 11, wherein said air entangler includes an air jet interlacer which forms regular nodes in the yarn separated by no more than 6 cms.

19. The system of claim 18, wherein said air jet interlacer forms regular nodes in the yarn having a node harshness of less than 2.0.

20. The system as in claim 11, wherein step (a) is practiced such that said substantially parallel equidistant position is maintained over a distance sufficient to substantially normalize tension on said feed ends.

21. The method of claim 20, wherein said distance is at least 1 cm.

22. The method of claim 20, wherein said distance is between about 3 cms to about 9 cms.

* * * * *